United States Patent [19]

Cleaveland

[11] Patent Number: 4,462,126

[45] Date of Patent: Jul. 31, 1984

[54] SINK FOR SEATED USER

[76] Inventor: Mildred S. Cleaveland, 6 Tanner Ct., P.O. Box 689, Murphys, Calif. 95247

[21] Appl. No.: 449,549

[22] Filed: Dec. 13, 1982

[51] Int. Cl.[3] ..... A47K 1/04

[52] U.S. Cl. ..... 4/619; 4/630; 4/661

[58] Field of Search ..... 4/619, 630, 624, 621, 4/553, 519, 515, 191, 661

[56] References Cited

U.S. PATENT DOCUMENTS

| | | | |
|---|---|---|---|
| 349,875 | 9/1886 | Crocker | 4/619 X |
| 2,009,225 | 7/1935 | Farrar | 4/630 |
| 2,426,152 | 8/1947 | Meldahl | 4/630 |
| 2,725,272 | 11/1955 | McCartan | 4/630 X |
| 2,814,809 | 12/1957 | Boyle | 4/630 |
| 2,965,906 | 12/1960 | Mullett et al. | 4/624 |
| 4,193,141 | 3/1980 | Rosenberg et al. | 4/621 |

*Primary Examiner*—Henry K. Artis

[57] ABSTRACT

The sink includes a basin with a drain-equipped rear portion of usual depth, or of depth adequate to perform intended tasks, and a substantially shallower forward portion. The exterior bottom of the sink portion in the front of that basin is correspondingly recessed to accommodate the knees and part of the lap of a seated user. Beside the stepped basin, the sink may have a second basin, for instance wholly of conventional depth. A number of optional sink inserts are disclosed including an imperforate pan and a perforated pan, each adapted to be removably disposed in the forward portion of a basin of the sink on two laterally spaced supports. A chopping block may be removably supported in one of the pans.

14 Claims, 7 Drawing Figures

SINK FOR SEATED USER

BACKGROUND OF THE INVENTION

For a person who is constrained to prepare meals or otherwise use a sink while seated in a wheelchair, the design of conventional sinks complicates the task at hand. It detracts from the simple pleasure which can be experienced, for instance, in making an apple pie from scratch, when the sink and its cabinet prevent the user from getting close enough to comfortably wash and peel the apples. Some may not be able to reach faucet of a conventional sink. With most conventional sinks, the choice is between pulling the wheelchair up to the sink sideways and trying to do most of the work with the hand that is closest to the sink, or finding some other way, such as not working at the sink.

The mentioned shortcoming of conventional sink designs impinges on others who are not necessarily wheelchair users. There are others who, whether for reasons relating to health, or simply to comfort or preference, would rather if they could, be seated while working at the sink, especially for long tasks.

The fundamental problems for a seated user is that the user's knees bang into the conventional sink or the cabinet front under the sink several inches before the user is close enough to the sink basin to comfortably undertake the work that needs to be done.

Others have sought to provide specialized sink constructions for seated users, but generally the approach has been to make the sink vertically movable, which complicates the plumbing and mounting. Another proposed solution has been to make the sink somewhat crescent-shaped, but that eliminates the central front part of the sink, the very portion which should be most accessible.

SUMMARY OF THE INVENTION

The sink includes a basin with a drain-equipped rear portion of usual depth, or of depth adequate to perform intended tasks, and a substantially shallower forward portion. The exterior bottom of the sink portion in front of rear portion is correspondingly recessed to accommodate the knees and part of the lap of a seated user. This stepped basin may comprise a single sink, or it may be laterally attached to a second differently stepped basin, or it may be laterally attached to a second basin of conventional or compatible dimensions. A number of optional sink inserts are are disclosed including an imperforate pan and a perforated pan, each adapted to be removably disposed in the forward portion of a basin of the sink on two laterally spaced supports. A chopping block may be removably supported in one of the pans.

DETAILED DESCRIPTION OF THE PREFERRED EMBODIMENT

Figure 1:
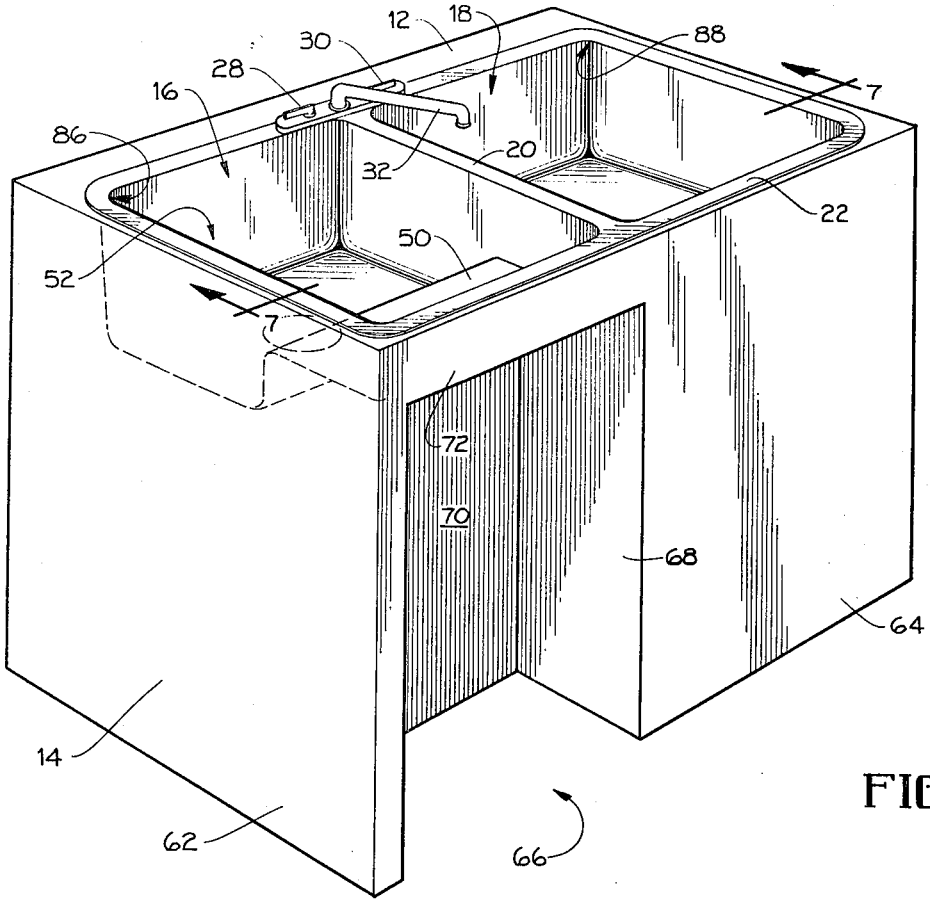
FIG. 1 is a perspective view of a sink installation illustrating principles of the present invention.
Figure 2:
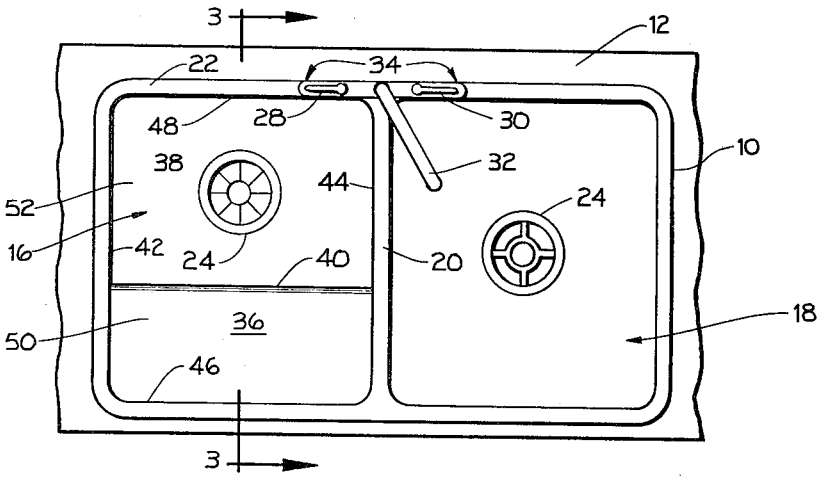
FIG. 2 is a fragmentary top plan view thereof.

In FIGS. 1–3 and 7, a rimmed double sink 10 is shown conventionally mounted in a countertop 12 which forms the top wall of a base cabinet 14. The sink 10 as illustrated is of the double-basin type having a novel, frontally-stepped basin 16 disposed laterally adjacent to a conventional basin 18. The two basins 16, 18 are separated by an upstanding web 20, and the grouped central structure 16, 18, 20 is shown perimetrically surrounded by a generally horizontal flange or rim 22.

The sink 10 may be conventionally plumbed. That is, each basin 16, 18 generally centrally of its bottom may be provided with a waste drain 24, either of which may be conventionally fitted with a food waste grinder 26. Conventionally for a rimmed household kitchen sink, the swivelable spigot 32, together with a lever which swivels from hot to cold, or, together with hot and cold water faucets 28, 30, are provided in an appropriate unitary structure 34 which may be mounted on the sink rim 22 centrally at the rear. Accordingly, the spigot 32 may be slewed so as to dispense water alternatively into either basin 16, 18.

What should be particularly noticed about the basin 16 is that it is not generally of equal depth, nor does its bottom nearly gently slope toward its drain 24. Rather, the front portion 36 of its bottom wall is rather abruptly and substantially stepped-up from the rear portion 38 of its bottom wall, at a ledge 40 which extends from the left sidewall 42 to the right sidewall 44 of the basin 16. Accordingly, the front sidewall 46 of the basin 16 is substantially shorter than the rear sidewall 48 thereof, because it is based at a substantially higher level; all of the sidewalls 42–48 extend up to the same level, that of the rim 22.

Preferably the drain 24 of the basin 16 is located at the lateral geometric center of the bottom of basin 16 and about 2½ inches rearward of the geometric center of the bottom of basin 16. The ledge 40 crosses the basin 16 somewhat to the front of drain 24, so a waste disposal unit would not project forward beyond the ledge 40.

By the foregoing means, a stepped, split-level basin is provided, having a shallow-depth frontal portion 50 and a normal, deeper depth rear portion 52.

The shallow-depth frontal basin may be used simply as a working surface, with water available in the drain-equipped rear portion.

Externally of the sink 10, an important consequence of the provision of the shallow frontal portion 50 of the basin 16, is that the corresponding portion of the sink has a highly unusual notched profile. Thus, although up near the rim, the sink 10 externally of the stepped basin 16 protrudes to a conventional extent at the exterior of the front sidewall 46, from the level of the elevated front portion 36 of the bottom wall and on down, the sink 10 is highly unconventionally substantially notched-out or recessed at 54. The recess 54 thus opens forwardly and downwardly and is of substantial height and depth. The top of this recess 54 is the external underside 56 of the front portion 36 of the bottom wall of the sink basin 16 and the back wall thereof is the external surface 60 of the ledge 40. The recess 54 extends the full width of the basin 16. The sink 10 may be mounted in a cabinet configured to take best advantage of the recess 54. An example is depicted in the drawing of FIG. 1. Here, all is conventional, as regards the countertop 12 supported on back (not shown), sidewalls 62 and a front wall 64, except that at a site corresponding to the location of the recess 54, the cabinet front wall 64 is notched at 66 to a like width and depth. The notch may be lined with generally vertical sidewalls 68 and a rear wall 70 which extends down to floor level flushly with the external front surface 60 of the ledge 40 of the basin 16. The region 72 of the cabinet front wall 64 extending over the notch 66 preferably is not much thicker than the countertop 12 and preferably extends down at most to the level of the top 56 of the recess 54.

The rear wall 70 may be provided in the form of a door or doors of any type conventionally provided on kitchen base cabinets and the like. Alternatively, the door or doors 70 may be provided out at the plane of the front wall 64 of the cabinet, so that the notch 66 is effectively provided by simply opening the door or doors 70 outward.

Front wall 64 may be made compatible with adjacent cabinets by terminating door or doors 70, about 4 inches above the floor to provide a toe kick. Hinges and springs may be provided to hold doors in desired positions, open or closed. The floor, however, must be continuously level with other floor space, within notch 66, in order to permit partial entry of chair or stool.

In any event the notch 66 in combination with the recess 54 provides a frontally open volume of space extending the full width of the sink basin 16 and nearly up to the underside of the counter-top 12, for a depth of several inches. This frontally open volume of space may be suggestive of the kneehole recess of writing desk or vanity.

Figure 3:
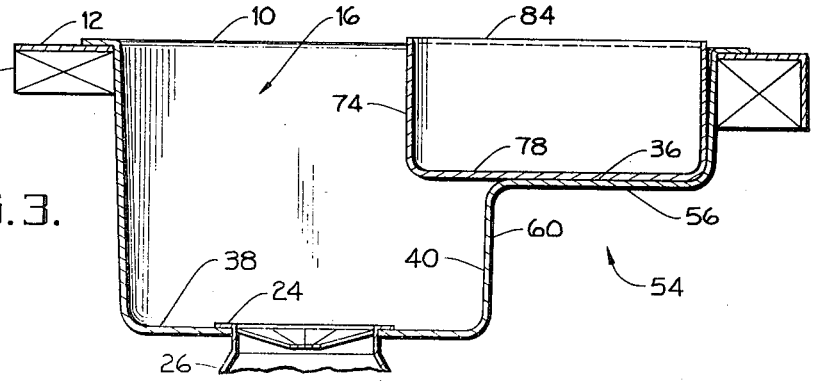
FIG. 3 is a fragmentary transverse vertical sectional view on line 3—3 of FIG. 2, and showing the imperforate tray of FIG. 4 in use.
Figure 4:
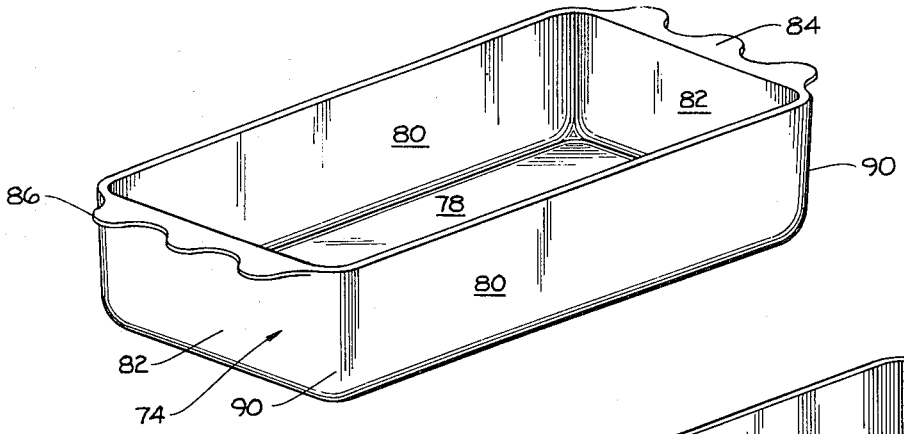
FIGS. 4, 5 and 6 are respective perspective views of an imperforate tray, a perforated tray and a chopping block tray insert for use in the preferred embodiment of the sink installation.
Figure 5:
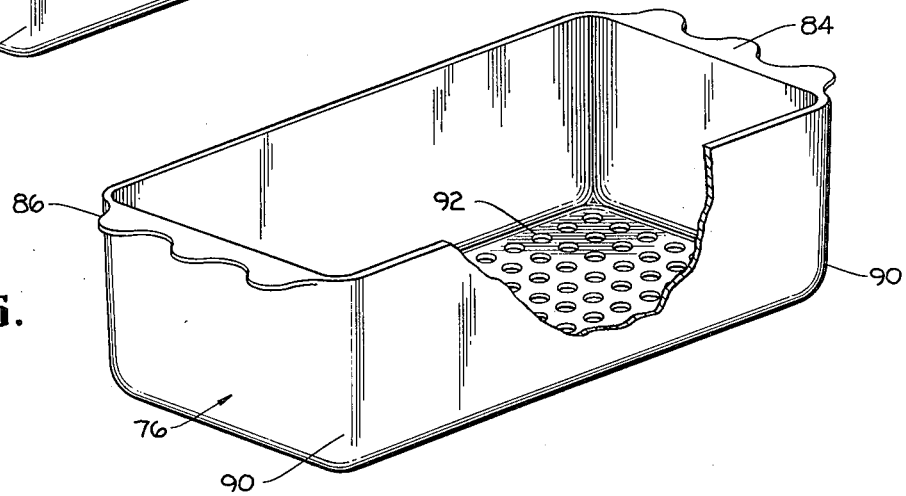
Figure 6:
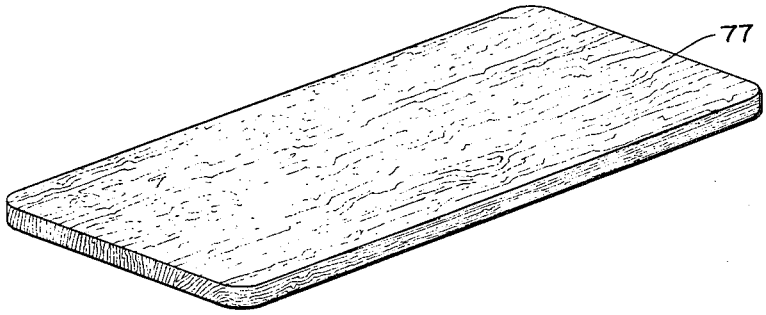
Figure 7:
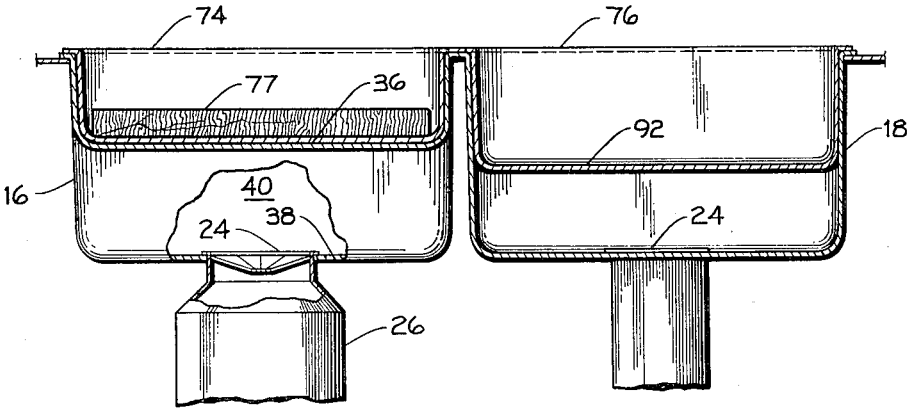
FIG. 7 is a fragmentary longitudinal vertical sectional view on line 7—7 of FIG. 1, showing both trays and the chopping block insert in use.

Shown separately in FIGS. 4, 5 and 6, and in useful association with the sink 10 in FIGS. 3 and 7, are three accessory structures which preferably are also provided. These are, namely, an imperforate tray 74, a perforated tray 76, and a chopping block or cutting board insert 77.

The tray 74 may have somewhat the shape of the body of an ice cube tray, i.e., it may be relatively shallow, with a flat bottom wall 78, elongated upstanding front and rear walls 80, and sidewalls 82 provided with horizontal rear-like handle flanges 84 extending laterally outwards at the top, by which the tray 74 may be removably suspended in a selected either basin 16, 18 or the sink 10. The suspension is effected by resting one flange 84 on the sink rim 22 and the other flange 84 on the web 20 which separates the two sink basins. The tray 74, as suspended, is no taller than and preferably slightly shallower than the shallow frontal portion 50 of the sink basin 16. In the front-to-rear direction, the tray 74 is preferably at least as deep as the sink basin portion 50, and preferably a little deeper. If the sink basin 16, 18 are conventionally concavely rounded at their respective laterally opposite front corners 86, 88 the corresponding corners 90 of the tray 74 preferably are correspondingly convexly rounded, so that the tray 74 may be disposed substantially fully to the front of either sink basin. If the tray 74 when suspended in use at the front of either sink basin does not extend to the rear sufficiently to be filled with water from the spigot 32, it is a simple matter to slide the tray 74 rearwardly while it remains suspended on the rim of the sink basin, for filling with water. Likewise, when the tray 74 is not being used, as an alternative to removing it or putting it or suspending it in the other basin of the sink, it may simply be pushed fully to the rear of the sink basin in which it remains suspended.

The other tray 76 may be substantially the same as the tray 74, except for having a pattern of holes 92 in its bottom and or peripheral walls so that it may be used as a collander, strainer, drain pan, sieve and the like.

The block 77 is shaped to removably fit in one or in either of the trays 74, 76 so as to take up substantially all the horizontal area and at least a substantial part of the height of the interior space of the respective tray. When in place, it may be used as a chopping block, cutting board or the like, and to that purpose may be made of any of the usual materials that such items customarily are made of, e.g., solid wood, laminated wood, polyethylene or the like.

Likewise the trays 74, 76 and the sink 10 may be made of conventional materials such as stainless steel; nickel steel; enameled steel; porcelain; hard, tough plastic material; plastic-coated steel and the like.

In order to give the interested reader a further appreciation of the preferred embodiment, some dimensions of a typical example will now be given. These dimensions should be understood in the spirit in which they are given and not considered to be limitative. (The wall thicknesses are insubstantial, typically one-eighth inch, and so are ignored in the following exemplification.) Typically, the countertop 12 is disposed at a height in the range of usual kitchen tables and countertops, i.e., in the range of 26–37 inches off the floor. The basin 16 typically is rounded-corner rectangular in top plan figure, typically measuring 14 inches in width, by 15.75 inches in front-to-rear depth. The rear portion of the basin 16 (and all of the similarly sized basin 18) is typically 7.5 inches vertically deep, with the step or ledge being typically 4 to 5.5 inches in height, so that the shallower frontal portion of the sink basin 16 typically is 2 to 3.5 inches vertically deep. The shallow portion typically extends 6 inches in the front-to-rear direction.

When the basin 16 is provided in a double-basin sink such as the sink 10, it may be provided at the left with a conventional basin at the right, at the right with a conventional basin at the left, or both basins may be of the novel stepped variety.

In the exemplary sink 10, the overall width of the sink including the rim 22 typically is 32 inches and the overall front-to-rear depth typically is 22 inches.

When the sink 10 is mounted in a countertop as shown, the resulting kneehole opening frontally of the basin 16 typically is about 9 or 10 inches deep in the front-to-rear direction due to addition of the corresponding countertop and sink rim flange dimensions to the typical 6 inch front-to-rear depth of the recess 54 in the sink basin 16.

The trays 74, 76 typically measure 7 inches by 14 inches in plan, plus 1 inch-wide handles at each end. Because the trays 74, 76 typically are an inch or so greater in front-to-rear depth than the shallow portion of the sink basin 16, it is easy to grasp and remove them even should it be difficult to lift them by the end handles once either is suspended in place in the sink basin 16. The vertical depth of each tray 74, 76 typically is 2 to 3.5 inches. The imperforate tray 74 can be thought of as a mini-sink insert, the use of which can be part of a conscious effort to conserve water. Either tray may be used as a support for drinking glasses as the same are being filled with water from the spigot.

The cutting board/chopping block 77 typically is 1 inch or more in thickness.

The sink 10 may be used in new installations, or as a replacement sink.

Although the sink 10 has been shown as a double-basin sink with a complete rim, the principles of the invention could be employed on a corner sink, a rimless sink, or on one having only a single basin, a single basin with an integral laterally extending drainboard, a double basin with a laterally extending drainboard and the like. And, whereas the invention has been disclosed in detail in the context of a kitchen and food preparation, the principles of the invention can be put to equally good use on sinks located in other places where work at the sink is to be done, whether it be in bathrooms, laundry rooms, hospitals, laboratories, food processing plants or factories. It is not essential that the sink be generally rectangular in plan figure; that is merely the shape of most sinks and what is considered preferably because that shape is most commonly in use.

In any event, use of the sink and sink installation as described permits a person while seated at the sink to have his or her feet, shins, knees and front part of lap comfortably recessed under the shallow portion of the sink. Further, use of the tray and block insert accessories facilitates work at the sink by a seated worker, as items may be washed or filled, drained, cut or otherwise processed in low volume, convenient height mini-sinks, and the like.

It should now be apparent that the sink for seated user and accessories as described herein are well suited for accomplishing the objects of the present invention, the scope of which is defined by the following claims.

What I claim is:

1. A sink for a seated user, comprising:

at least one basin including bottom wall means and perimetrical upstanding sidewall means including a front, a back and two laterally opposite sides;

means providing a drain opening through said bottom wall means;

wall means providing a ledge of substantial height extending between said two laterally opposite sides of said upstanding sidewall means and upper and lower margins;

said bottom wall means being provided in at least two generally horizontal portions including a rear portion disposed at a first, lower level, including said drain opening and joining the lower margin of said ledge, and a front portion disposed at a second, higher level and joining the upper margin of said ledge;

said sink being at least generally correspondingly frontally and downwardly recessed as an external consequence of the provision said bottom wall means front portion at said second, higher level, and said ledge extending down to said first, lower level rearwardly of said front of said perimetrical upstanding sidewall means of said basin.

2. The sink of claim 1, further comprising:

a second basin disposed laterally adjacent the first-described basin and separated therefrom by an upstanding web.

3. The sink of claim 2, further comprising:

a rim perimetrically surrounding as a unit the first described and second basins and web.

4. The sink of claim 3, further comprising:

a faucet unit mounted on said rim centrally between said basins, to the rear of said web, said faucet unit including hot and cold water valve means and a spigot swivelable to the left and to the right so as to be capable of dispensing water selectively into either of said basins.

5. The sink of claim 1, wherein:

said front portion of said bottom wall constitutes approximately one-third of the bottom of said basin.

6. The sink of claim 1, wherein:

said portion of said bottom wall measures about six inches in front-to-rear horizontal dimension.

7. The sink of claim 1, further optionally comprising:

a tray removably suspended in said basin, said tray including a bottom wall, an upstanding perimetrical sidewall and two laterally oppositely projecting flange means by which said tray may removably and forwardly/rearwardly slidably rest upon said sink adjacent said two laterally opposite sides of said perimetrically upstanding sidewall means of said basin; said tray as suspended having said bottom wall thereof disposed at a level not lower than said second higher of said front portion of said bottom wall means of said basin.

8. The sink of claim 7, wherein:

said tray is upwardly open and substantially imperforate so that it may hold water and function as a mini-sink.

9. The sink of claim 7, wherein:

at least one of said bottom wall and said perimetrical sidewall of said tray is perforated by means defining a plurality of small openings therethrough so that said tray may function as a collander.

10. The sink of claim 7, further including:

a block of solid material removably seated on the horizontal area of the tray for use as a cutting board.

11. The sink of claim 10, wherein:

the block is made of wood and is at least one-inch thick.

12. The sink of claim 7, wherein:

said tray is on the order of one inch greater in front to rear horizontal dimension than said front portion of said bottom walls means of said basin.

13. A sink installation, comprising:

a base cabinet having perimetrical upstanding wall means surmounted by a generally horizontal countertop, said wall means including a front wall;

a sink mounted in said countertop adjacent said front wall;

a said sink comprising:

at least one basin including bottom wall means and perimetrical upstanding sidewall means including a front, a back and two laterally opposite sides;

means providing a drain opening through said bottom wall means;

wall means providing a ledge of substantial height extending between said two laterally opposite sides of said upstanding sidewall means and upper and lower margins;

said bottom wall means being provided in at least two generally horizontal portions including a rear portion disposed at a first, lower level, including said drain opening and joining the lower margin of said ledge, and a front portion disposed at a second, higher level and joining the upper margin of said ledge;

said sink being at least generally correspondingly frontally and downwardly recessed as an external consequence of the provision said bottom wall means front portion at said second, higher level, and said ledge extending down to said first, lower level rearwardly of said front of said perimetrical upstanding sidewall means of said basin, and means defining a notch in said front wall of said cabinet frontally of said basin of said sink, said notch extending back substantially to said ledge, and extending laterally substantially at least the full width of said basin, and extending vertically from floor level to substantially above said first, lower level of said rear portion of said bottom wall means of said basin.

14. The sink installation of claim 13, wherein:

said sink and said notch together means defining a kneehole for receiving the feet, shins, knees and lap front of a user when such user is seated frontally of said basin.

* * * * *